US005393942A

United States Patent [19]

Reiner et al.

[11] Patent Number: 5,393,942

[45] Date of Patent: Feb. 28, 1995

[54] PANELBOARD HAVING PANEL-MOUNTED INTERLOCK FOR TWO MAIN CIRCUIT BREAKERS

[75] Inventors: Richard A. Reiner, Colgate, Wash.; Loy A. Hicks, Jr., Germantown, Wis.

[73] Assignee: Eaton Corporation, Cleveland, Ohio

[21] Appl. No.: 216,736

[22] Filed: Mar. 23, 1994

[51] Int. Cl.[6] ..... H01H 9/26

[52] U.S. Cl. ..... 200/50 C; 361/627

[58] Field of Search ..... 200/5 E, 5 B, 5 C, 50 C, 200/DIG. 6, 43.01–43.22; 74/483 R; 361/627–640

[56] References Cited

U.S. PATENT DOCUMENTS

| | | | |
|---|---|---|---|
| 3,196,227 | 7/1965 | Carter et al. | 200/50 C |
| 3,319,020 | 5/1967 | Shaffer | 200/50 C |
| 3,369,100 | 2/1968 | Kussy et al. | 200/50 CX |
| 3,611,048 | 10/1971 | Shelvik | 361/650 |
| 3,801,758 | 4/1974 | Shand et al. | 200/50 C |
| 4,270,031 | 5/1981 | Borona et al. | 200/50 C |
| 4,435,739 | 3/1984 | Shelvik | 361/627 |
| 4,924,041 | 5/1990 | Yee | 200/50 C |
| 5,008,499 | 4/1991 | Yee et al. | 200/50 C |

OTHER PUBLICATIONS

Two photographs marked "Cutler-Hammer, Jul. 27, 1988, Catalog CH063MEN60, Bell Labs, 3A. Photo No. CH P-16 and CH P-17."

Photograph marked "Cutler-Hammer CH7 BBSM". Records indicate this photograph was made Oct. 21, 1988.

*Primary Examiner*—J. R. Scott

*Attorney, Agent, or Firm*—L. G. Vande Zande

[57] ABSTRACT

An interlock between two main circuit breakers comprises a bracket mounted to the interior panel transversely of the panel and a sliding interlock member mounted on a forward portion of the bracket, which portion fits within the unmodified opening of a panelboard cover and fills the space within the opening between the two main circuit breakers. Padlock hasps may be provided on the interlock member to additionally lock either or both main circuit breakers in an OFF condition. Tabs on the bracket overlie forward facing surfaces of the main circuit breakers to block removal of the main circuit breakers while the bracket is installed.

9 Claims, 5 Drawing Sheets

Fig. 1
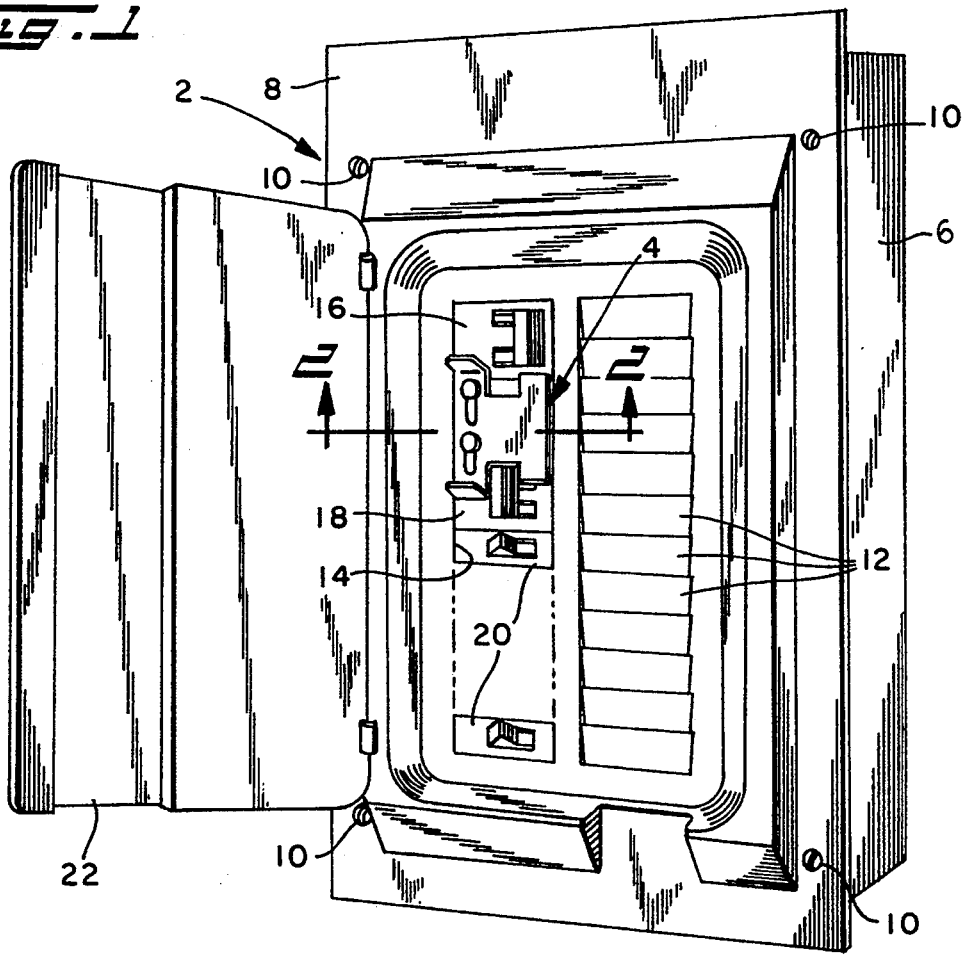
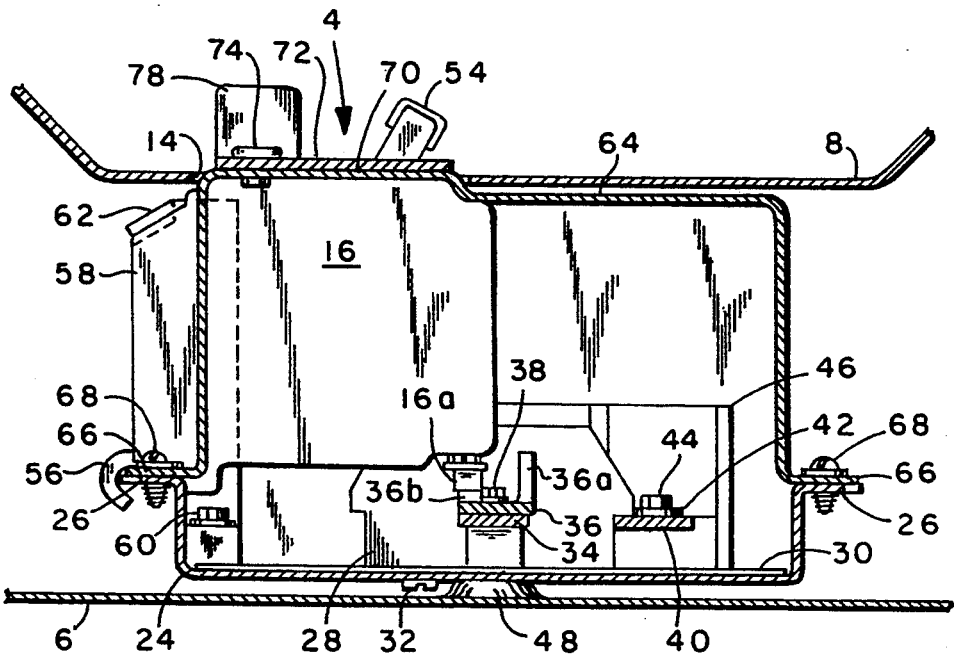
Fig. 2

PANELBOARD HAVING PANEL-MOUNTED INTERLOCK FOR TWO MAIN CIRCUIT BREAKERS

BACKGROUND OF THE INVENTION

This invention relates to electric circuit breaker panelboards and more particularly to such panelboards which incorporate a pair of main circuit breakers for selectively switching the electrical supply to the panelboard between a primary source, such as the utility, and an alternate source, such as a generator. It is necessary that the main circuit breakers be prohibited from being contemporaneously operated to the ON condition. This invention relates particularly to a mechanical interlock for preventing contemporaneous operation of both main circuit breakers to the ON condition.

Mechanical interlocks which interconnect a pair of lever operated switches are well known. The assignee of this application has offered several variations of such interlocks. In circuit breaker panelboards, one such interlock has been mounted on the cover and has slidably interacted with the operator handles of tandemly (transversely) mounted circuit breakers. However, the interlock function is removed with the cover when servicing the panelboard in this version. Another panelboard has a sliding interlock mounted on a bracket which extends along the longitudinal center line of the panel. The ends of the bracket extend along the sides of the respective circuit breakers and are bolted directly to the panel or to the enclosure. One end of the bracket is offset from the center of the panel to clear a bus bar of the panelboard. A different length bracket is required for each panel accepting a different number of circuit breakers which translates into a different length for the panel. It is also necessary to modify the cover opening for the circuit breakers by notching the opening to receive the bracket at each end of the row of circuit breakers since the bracket extends beyond the side surface of the end circuit breakers. Thus, special covers are provided panelboards or loadcenters utilizing this version sliding interlock. The provision of special parts increases the cost of the item, both to manufacture and stock the different parts.

SUMMARY OF THE INVENTION

This invention provides a mechanical interlock for the operator handles of two main circuit breakers mounted in a panelboard or loadcenter. The interlock mounts transversely of the interior panel and therefore is not dependent upon the length of the interior panel. The interlock requires no special modification of any parts of the loadcenter or panelboard, thereby using all standard parts. The interlock attaches to the mounting rails of the interior panel by screw fasteners or the like and therefor can be used to provide a hold-down function for the main circuit breakers, thereby eliminating separate components for this function. The interlock slide may also be provided with padlock hasps whereby the operator handles of one or both of the circuit breakers may be locked in the OFF position by inserting the padlock shackle through the appropriate hasp of the interlock slide.

BRIEF DESCRIPTION OF THE DRAWINGS

FIG. 1 is a perspective view of a panelboard or loadcenter with the door open, showing the interlock assembly as it appears through the opening in the cover for the two main circuit breakers;

FIG. 2 is a sectional view taken along line 2—2 in FIG. 1;

DETAILED DESCRIPTION OF THE INVENTION

Figure 3:
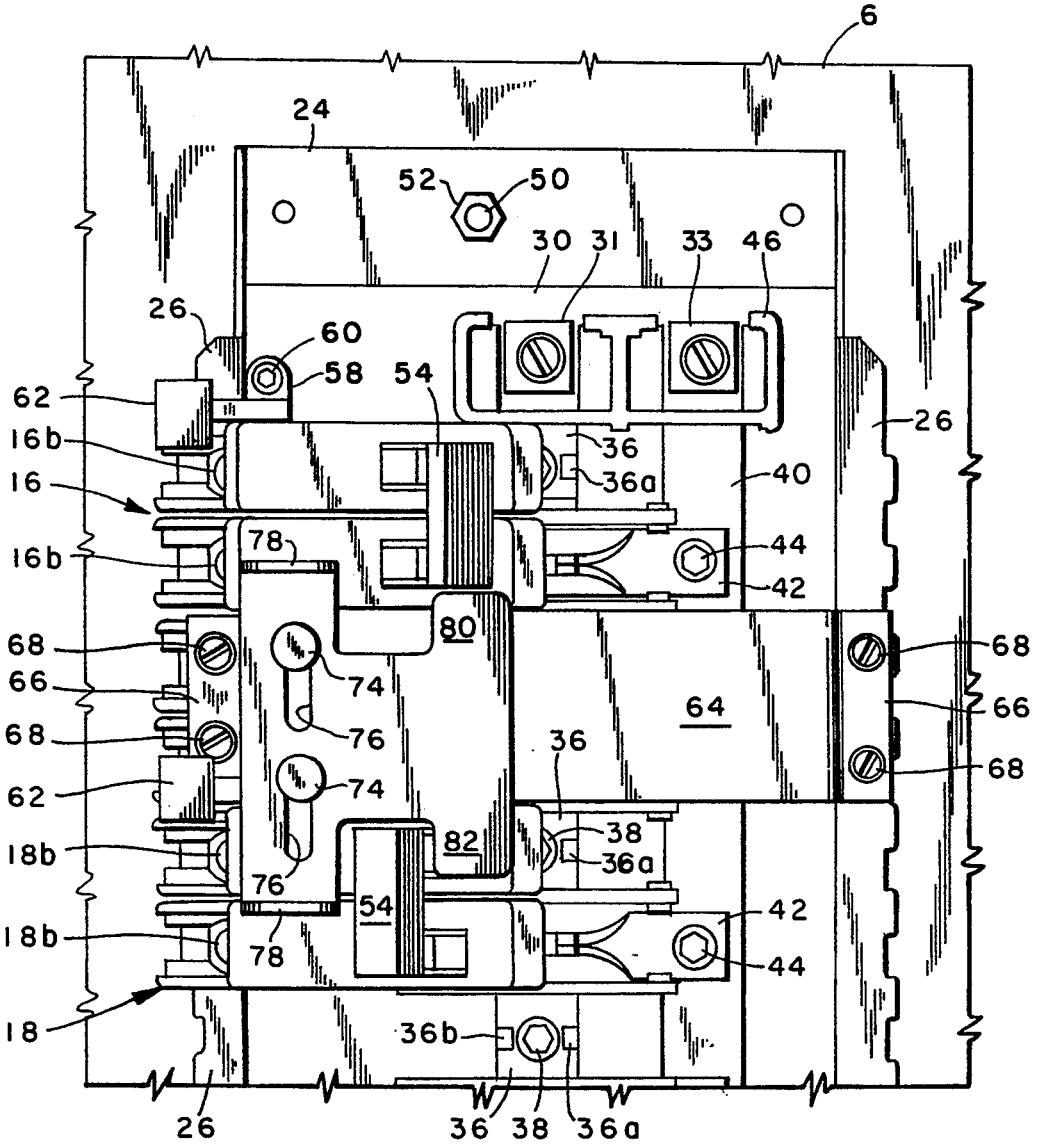
FIG. 3 is a front plan view of a portion of the interior panel of the panelboard or loadcenter of FIG. 1, showing the two main circuit breakers and the interlock assembly of this invention.
Figure 4:
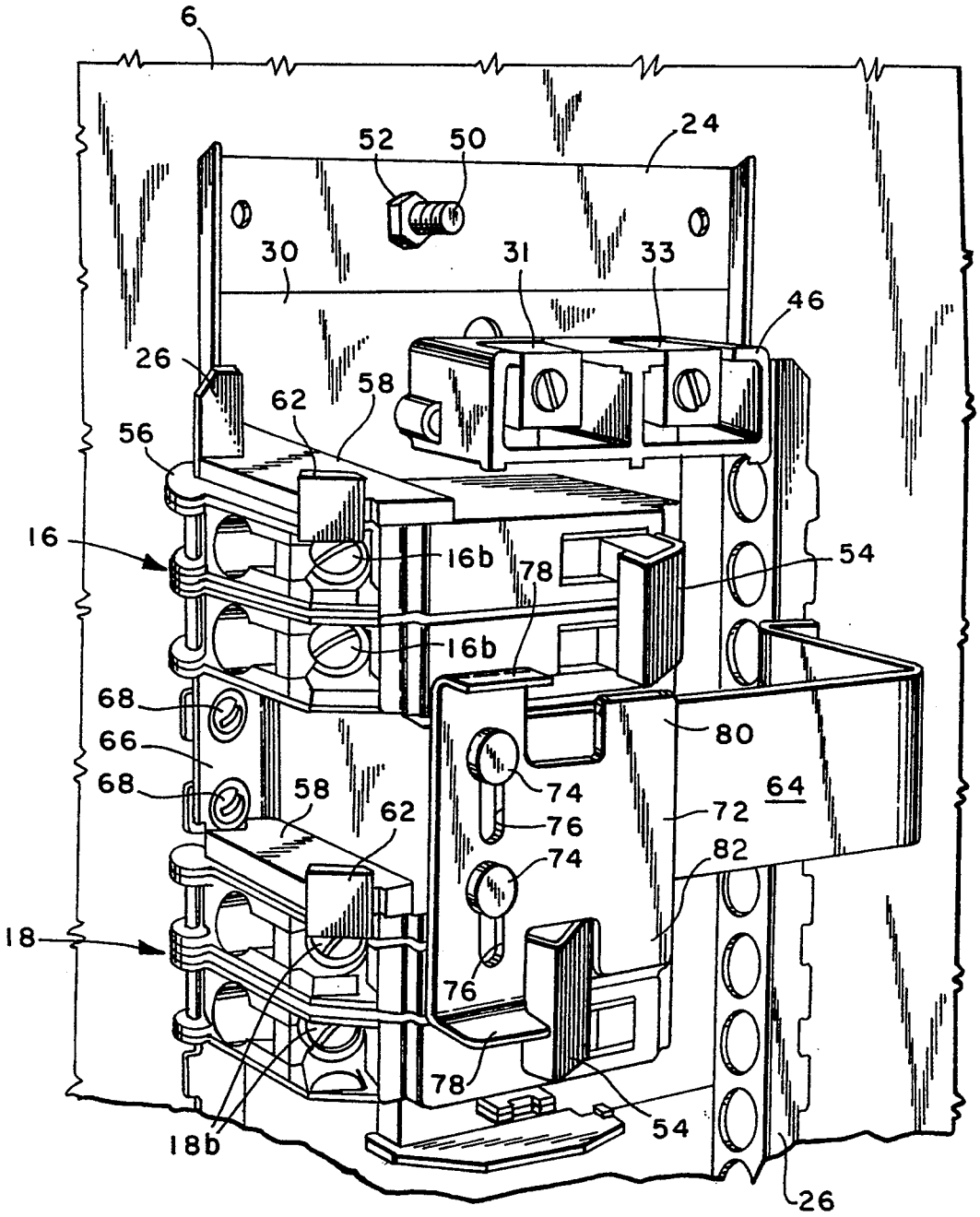
FIG. 4 is a perspective view of a segment of the panelboard interior, two main circuit breakers and the interlock assembly of this invention.

Referring to the drawings, FIG. 1 shows a panelboard, more particularly a loadcenter 2 to which the interlock 4 of this invention is applied. The loadcenter comprises an open-front box 6 having a cover 8 attached over the open front thereof by screws 10. Cover 8 has two vertical rows of rectangular twist-outs 12, the twist-outs in the left-hand row all being removed to provide a long rectangular opening 14. The forward portions of a pair of main circuit breakers 16 and 18 extend through the opening 14 in the upper segment thereof. The forward portions of branch circuit breakers 20 also extend through the opening 14 in the lower segment thereof to fill the opening 14. A door 22 is hinged to cover 8 and is closable upon the cover 8 over the circuit breakers 16, 18 and 20 and over the remaining row of twist-outs 12.

Cover 8 may be removed from box 6 for installation of circuit breakers or other service to the loadcenter. Within the box 6 is an interior panel 24 which is a shallow U-shaped channel having outwardly directed flanges 26 extending along the free ends of the upright legs of panel 24 at substantially right angles thereto. The flanges 26 serve as mounting rails for circuit breakers to be installed to the panel. In the embodiment shown, the panel is for a two phase system and has a plurality of insulators 28 mounted in a row extending longitudinally of the panel 24 midway between the upright legs of the panel. An insulating sheet 30 is disposed against the flat major back portion of the panel. The insulators 28 are positioned upon the insulator 30 and are secured in place by screws 32 which extend through holes in the panel 24 and insulator 30 to threadably engage openings in the back sides of the insulators 28.

A center bus bar 34 is attached to the plurality of insulators 28 by electrical connectors 36 and screws 38 which extend through holes (not shown) in connector 36 and threadably engage in holes (not shown) in bus bar 34 to trap the assembly against various formations (not shown) in the insulators 28. The connector 36 has a pair of upstanding posts **36*a* and 36*b* to which circuit breaker terminals such as 16*a* may be plug-in attached as shown at 16*a* and 36*b* in FIG. 2. A second bus bar 40 is attached against the outer right-hand sides of the insulators 28 by branch electrical connectors 42 which are attached to the bus bar 40 by screws 44 to trap the assembly to the insulators 28. The branch electrical connectors 42 extend to the center of the insulators 28 and have a pair of upstanding projections (not shown) similar to projections 36***a* and 36*b* for receiving the plug-in terminal of a circuit breaker in a well known manner. A lug main insulator block 46 is attached to panel 24 at the top thereof to provide an insulator around wiring lugs 31 and 33 FIG. 3 attached to the bus bars 34 and 40. The panel as thus far described is generally known as an interior assembly for a panelboard or loadcenter and is mounted to the back wall of the box 6. To this end, the back wall of the box 6 is provided with forwardly extending bosses 48 which have threaded posts 50 welded therein and extending forwardly within the box. Panel 24 has holes (now shown) aligned with the posts 50 and is assembled over the posts 50 against the bosses 48 and secured there with nuts 52. For a more thorough understanding of the panelboard interior, reference may be had to U.S. Pat. No. 3,611,048 issued Oct. 5, 1971, to Bertrum S. Shelvic and assigned by mesne assignments to the assignee of this invention.

When it is desired to use the panelboard as service entrance equipment, it is necessary to provide a main disconnect switch for the panelboard. To achieve this, a double pole circuit breaker is mounted in the first two pole spaces provided by the insulators 28 below the lug main insulator block 46. A channel shaped handle tie member 54 is attached to the operator handles of the two breakers comprising main circuit breaker 16 to cause the individual breakers to be manually operated simultaneously. As seen in FIG. 2, the breakers have a hook 56 at the lower outermost corner of the breaker housing, which hook is engaged over the flange 26 providing the mounting rail function. The breaker is then pivoted rearwardly to engage the plug-in terminal 16*a* thereof with the appropriate projection 36*b* and similar projection on branch electrical connector 42 to mechanically and electrically attach the circuit breaker 16 to the panel. When used as a main breaker, incoming wires from the supply such as a utility feed are connected to the wiring lugs 16*b* of the main circuit breaker 16, and the respective individual poles of the two pole main circuit breaker 16 supply incoming electrical power to the respective busses 34 and 40 via their plug-in connection thereto in the ON condition of the circuit breaker 16.

A UL requirement for plug-in main circuit breakers is that they not be directly removable without using a tool. To inhibit removal of the main breaker 16, hold-down bracket 58 is provided. The bracket comprises a base portion which is attached to panel 24 adjacent an upright leg by screws 60 (FIG. 2). Hold-down bracket 58 extends alongside the housing of circuit breaker 16 and has a T-shaped hook portion 62 at its forward end, one leg of which hooks over an insulating barrier of the circuit breaker housing to block removal of the circuit breaker without first removing the hold-down bracket 58. For a more thorough understanding of the hold-down bracket 58, reference may be had to U.S. Pat. No. 4,435,739 issued Mar. 6, 1984 to Bertrum S. Shelvic and assigned to the assignee of this invention.

In certain applications of service entrance equipment, such as in the telecommunications industry, the panelboard or loadcenter is used in a switching cabinet. The panel is connected to utility power as heretofore described by connecting an incoming electrical feed to the main circuit breaker 16. However, to provide for emergency power, an alternate power supply is connected to a second main circuit breaker 18 which is identical to circuit breaker 16. If main utility power is interrupted for any reason, the main breaker 16 can be turned off and the alternate power supply breaker 18 turned on to supply the loadcenter from the alternate power source. However, both power supplies should not be connected to the panelboard at the same time. In order to prevent this, the interlock assembly 4 of this invention is provided.

As may be seen in the drawings the main breakers 16 and 18 are mounted spaced apart along the panel 24. The breakers are specifically spaced apart two pole spaces. The interlock assembly 4 comprises a bracket 64 which has essentially an inverted U-shape, having outwardly extending flanges 66 at the free ends of the vertical legs. Flanges 66 are attached to the flanges 26 of panel 24 by pairs of screws 68 which extend through clearance holes (not shown) in the flanges 66 and threadably engage in holes (not shown) in the flange 26. As viewed in FIG. 2, the left end of bracket 64 has a forward portion 70 which is disposed essentially flush with the respective forward surface of circuit breakers 16 and 18 and projects through the opening 14 in the cover 8. An interlock plate 72 is slidably attached to the outer surface of forward portion 70 by a pair of shouldered rivets 74 which extend through elongated slots 76 in interlock plate 72 and through holes (not shown) in forward portion 70 and are riveted to the forward portion to loosely guide the plate 72 for sliding movement.

When viewed from the front, interlock plate 72 is essentially H-shaped having a left-hand leg containing the slots 76 which serve to guide the plate for sliding movement. The upper and lower ends of the left-hand leg are provided with forwardly directed flanges 78 which function as handles for moving the slider upwardly; gravity biases the slider to its lowermost position in the normal orientation of the panelboard apparatus. The right-hand leg of the H-shaped slider 72 comprises a pair of oppositely directed tabs 80 and 82 extending in the direction of sliding movement of the slider 72. Tabs 80 and 82 align with the operator handles of the circuit breakers 16 and 18 when the same are in the ON position such as circuit breaker 16 in the drawings. This alignment causes the end of tab 80 to abut the side of the handle of circuit breaker 16 and blocks sliding movement of the interlock plate 72 upward while the circuit breaker 16 is in the ON condition. As can be seen in the drawings; in this position of the interlock plate 72, the space between the left and right-hand legs on the lower side of the slider 72 is occupied by the handle of the circuit breaker 18 when that handle is in the OFF condition. The lower right-hand tab 82 blocks movement of the handle operator of circuit breaker 18 to the 0N condition while the interlock plate 72 is in the position shown in the drawings.

To switch from the electrical supply source wired through main circuit breaker 16 to the electrical supply source wired through main circuit breaker 18, it is necessary to first turn main circuit breaker 16 off. In so doing, the handle operator of circuit breaker 16 moves leftward, free of upper right-hand tab 80 of interlock slide 72, enabling the slide to be moved upward to cause lower right-hand tab 82 to clear the operator handle of circuit breaker 18. Circuit breaker 18 can then be turned to the ON condition by moving the handle to the right. Once turned on, the interlock plate 72 may be released and lower right-hand tab 82 will rest upon the side surface of the operator handle of circuit breaker 18, maintaining the interlock plate in the position whereby upper right-hand tab 80 blocks movement of the operator handle of circuit breaker 16 to the ON position.

The interlock assembly 4 may be conveniently attached to a standard panelboard without modification of the panelboard. The panel 24 will have holes (not shown) provided in the flanges 26 at the third and fourth pole spaces to receive screws 68. The forward portion 70 of bracket 64 and the slide plate 72 fully fit within the opening 14 of cover 8 and therefore do not require special modification of the cover or its opening. Bracket 64 mounts transversely on panel 24 and therefore is independent of the variable length of such panels according to the number of circuits that can be provided by the particular panelboard. Bracket 64 is made sufficiently wide to fill the space between main circuit breakers 16 and 18 within the opening 14, thereby preventing unauthorized or accidental access to the interior of the panelboard through the opening. The interlock assembly is mounted directly to the panel so that when the cover is removed, the interlocking function remains operable.

Figure 5:
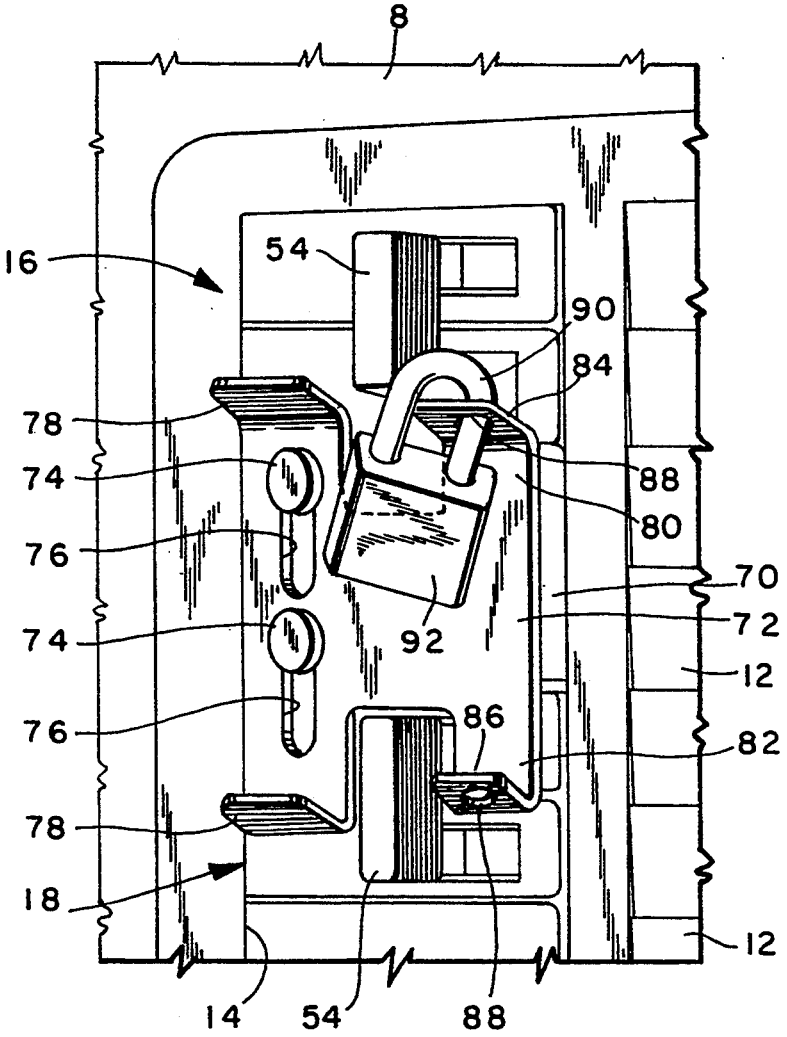
FIG. 5 is a perspective view of the interlock assembly of this invention modified to provide padlock hasps adjacent the operating handles of the main circuit breakers.

An alternative embodiment of the interlock assembly of this invention is shown in FIG. 5. Forwardly directed flanges 84 and 86 are added to the distal ends of upper and lower tabs 80 and 82, respectively. The flanges 84 and 86 extend substantially parallel to the sides of the operator handles. Each of the flanges 84 and 86 are provided with a hole 88 to receive the shackle 90 of a padlock 92. With the slider plate 72 in its lowermost position as shown in FIG. 5, the operator handle of circuit breaker 18 is received in the space between the lower left leg and lower right-hand tab 82 of slider plate 72, thereby blocking the handle operator from movement to the ON position. A padlock 92 attached to the flange 94 at the upper right-hand tab 80 extends into the path of the operator handle of circuit breaker 16 when that handle is in the OFF position and blocks movement of the handle to the ON position. Accordingly, the use of the padlock hasps provided by flanges 84 and 86 permits both main circuit breakers to be held in their OFF position. A second padlock through the lower hasp 86 would also positively prevent the lower breaker 18 from being turned on without first removing the padlock.

Figure 6:
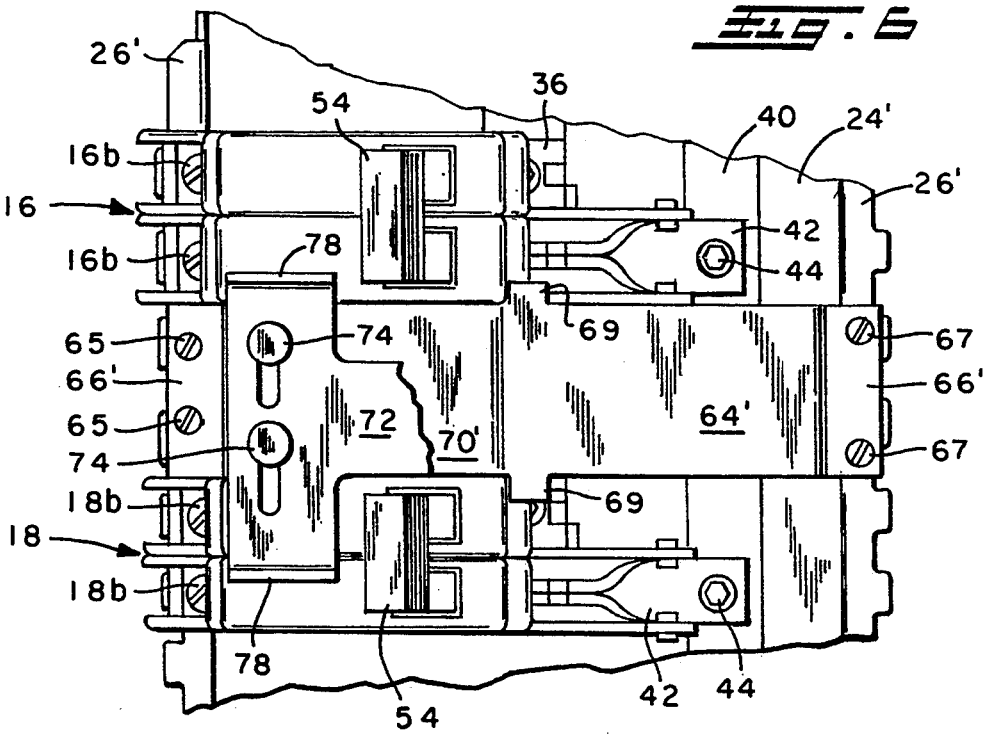
FIG. 6 is a front plan view of a segment of the interior panel, main circuit breakers and interlock assembly of this invention modified to provide a hold-down function for the main circuit breakers and keyed for particular orientation to the interior panel.
Figure 7:
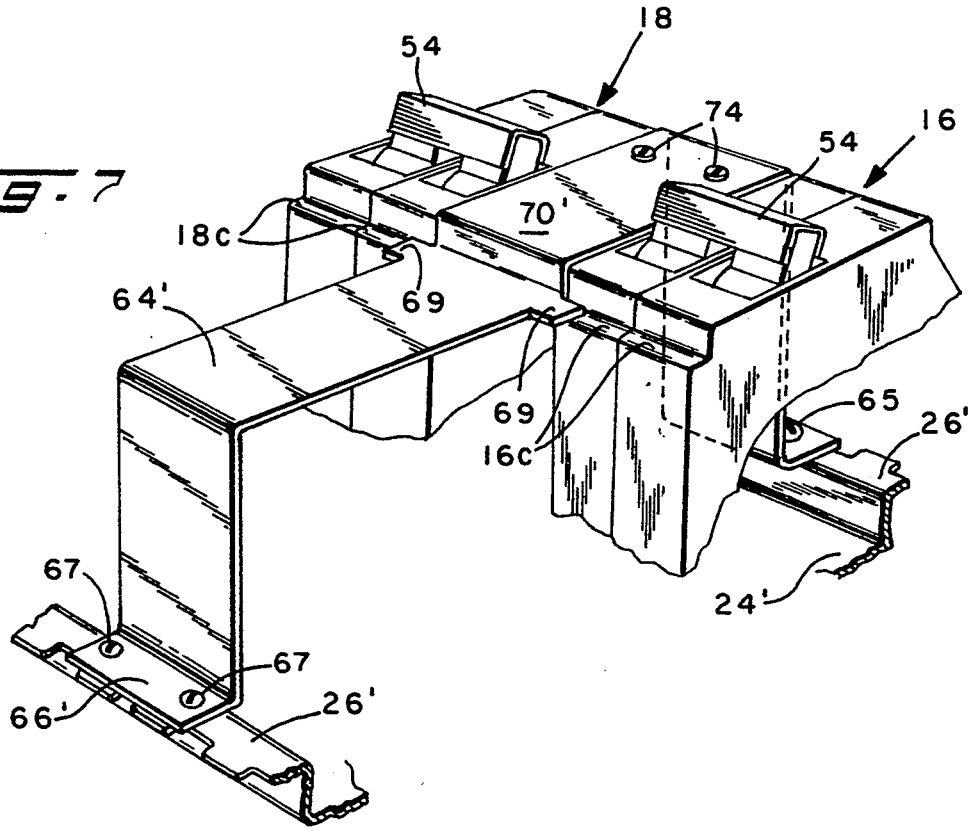
FIG. 7 is a fragmentary perspective view of the modified interlock assembly of FIG. 6.

Still another alternative embodiment of the interlock assembly of this invention is shown in FIGS. 6 and 7. Inasmuch as the bracket 64 is mounted to the mounting rails 26 of the interior panel 24 by screws 68, the bracket may be modified to provide the hold-down function of separate hold-down brackets 58, i.e. require the use of a tool to remove a plug-in main circuit breaker. As seen in FIGS. 6 and 7, bracket 64' is provided with a pair of oppositely directed tabs 69 immediately adjacent a step leading to forward portion 70'. Tabs 69 overlie forward-facing surfaces **16*c* and 18*c*, respectively, on main circuit breakers 16 and 18, blocking removal of the main circuit breakers from panel 24' until the bracket 64' is removed by removing screws 65 and 67. By using modified bracket 64', hold-down brackets 58 may be omitted from the interior panel assembly. It should also be noted that screws 67 are spaced further apart than screws 65 (FIG. 6) to insure correct orientation of bracket 64' on the panel. To this end, the holes (not shown) in the rails 26' of panel 24'** are provided at different spacing on the right rail than the left rail.

The foregoing describes the interlock assembly of this invention as may be provided on a panelboard or loadcenter adapted to receive circuit breakers thereon. The interlock assembly is shown and described in its preferred embodiment and the best mode contemplated for carrying out the invention at the time of this application. However, it is to be understood that the invention is susceptible of various modifications without departing from the scope of the appended claims.

We claim:

1. An electrical panelboard adapted to be supplied from primary and alternative electrical supply sources, said panelboard comprising:

a panel;

a pair of transversely spaced, longitudinally extending mounting rails on said panel;

insulators mounted on said panel;

a plurality of bus bars supported on said insulators;

first plug-in connector means on said bus bars being sequentially disposed at longitudinally spaced intervals along said panel intermediate said mounting rails, said insulators and said first plug-in connector means together defining a plurality of pole spaces on said panel;

first and second multi-pole main circuit breakers mounted to said panel, said main circuit breakers each comprising second plug-in connector means and a wire-receiving terminal for each pole thereof, one end of respective said main circuit breakers being attached to one of said mounting rails and respective said second plug-in connector means being engaged with respective said first plug-in connector means, said main circuit breakers each comprising an operator handle movable to operate the respective main circuit breaker between ON and OFF conditions, said wire-receiving terminals of one of said first and second main circuit breakers being connectable to a primary electrical supply source and said wire-receiving terminals of another of said first and second main circuit breakers being connectable to an alternative electrical supply source, said first and second main circuit breakers being operable in ON conditions thereof for connecting said bus bars with a respective said primary or alternative electrical supply source; and interlock means between said first and second main circuit breakers preventing both main circuit breakers from being contemporaneously operated to the ON condition, said interlock means comprising:

a bracket mounted transversely of said panel between said first and second main breakers, said bracket being attached to said mounting rails and comprising a forward portion disposed in substantial coincidental alignment with forward portions of said first and second main circuit breakers; and an interlock member movably mounted on said bracket forward portion, said interlock member being engagable with said operator handles of said first and second main circuit breakers, blocking movement of one of said operator handles from an OFF position when the other of said operator handles is in an ON condition.

2. The electrical panelboard defined in claim 1 further comprising:

an enclosure box having an open forward side, said panel being mounted in said box; and a cover attached to said box over said open forward side, said cover comprising an opening through which said operator handles and said forward portions of said main circuit breakers extend, said bracket filling a resulting space between said main circuit breakers within said opening, blocking access to said panel through said opening.

3. The electrical panelboard defined in claim 1 wherein said interlock member is mounted for reciprocal sliding movement longitudinally of said panel and comprises a pair of oppositely directed tabs extending in a direction of said longitudinal movement, said tabs being longitudinally aligned with said operator handles of said main circuit breakers in said ON condition of a respective main circuit breaker handle, a respective said tab abutting said operator handle of a main circuit breaker in an ON condition, thereby blocking sliding movement of said interlock member, and an opposite one of said tabs being disposed in interference with said operator handle of the other of said main circuit breakers blocking movement thereof to an ON condition of said other of said main circuit breakers.

4. The electrical panelboard defined in claim 3 wherein said interlock member is mounted on said bracket forward portion transversely outwardly of said operator handles and said tabs are disposed transversely inwardly of said operator handles in OFF conditions of said main circuit breakers.

5. The electrical panelboard defined in claim 4 wherein said interlock member comprises elongated slots and said bracket forward portion comprises shouldered pins extending through said slots attached to said forward portion for guiding said interlock member for said reciprocal sliding movement.

6. The electrical panelboard defined in claim 4 wherein said interlock member comprises forwardly projecting handle means.

7. The electrical panelboard defined in claim 3 wherein at least one of said oppositely directed tabs comprises a forwardly extending flange at a distal end of said tab, said flange being disposed transversely to said reciprocal sliding movement, said flange having a hole therethrough for recovering a shackle of a padlock and positioning said shackle in blocking interference with movement of an adjacent said operator handle in an OFF condition to an 0N condition.

8. The electrical panelboard defined in claim 1 wherein said bracket is attached to said mounting rails by pairs of screws at each mounting rail, holes in said mounting rail for securing said screws at one side of said panel being spaced closer together than corresponding holes in said mounting rail for receiving said screws at an opposite side of said panel.

9. The electrical panelboard defined in claim 1 wherein said bracket is attached to said mounting rail by screws, said bracket having oppositely directed tabs disposed over forward-facing portions of said main circuit breakers blocking removal of said main circuit breakers from said panel.

* * * * *